US008245791B2

(12) United States Patent
Kriedel et al.

(10) Patent No.: US 8,245,791 B2
(45) Date of Patent: Aug. 21, 2012

(54) HAND-HELD TOOL WITH A COUNTER-VIBRATION DEVICE

(75) Inventors: Joerg Kriedel, Neustadt (DE); Richard Engel, Sebnitz (DE); Otto Baumann, Leinfelden-Echterdingen (DE); Hardy Schmid, Stuttgart (DE); Holger Ruebsaamen, Stuttgart (DE); Mario Patzig, Zittau (DE)

(73) Assignee: Robert Bosch GmbH, Stuttgart (DE)

( * ) Notice: Subject to any disclaimer, the term of this patent is extended or adjusted under 35 U.S.C. 154(b) by 120 days.

(21) Appl. No.: 12/724,758

(22) Filed: Mar. 16, 2010

(65) Prior Publication Data

US 2010/0236804 A1 Sep. 23, 2010

(30) Foreign Application Priority Data

Mar. 17, 2009 (DE) ..... 10 2009 001 590

(51) Int. Cl.
*B25D 17/24* (2006.01)

(52) U.S. Cl. ..... 173/162.1; 173/162.2

(58) Field of Classification Search ..... 173/48, 173/104, 109, 162.1, 162.2, 201, 205
See application file for complete search history.

(56) References Cited

U.S. PATENT DOCUMENTS

| | | | | |
|---|---|---|---|---|
| 6,112,830 | A * | 9/2000 | Ziegler et al. | 173/109 |
| 7,331,407 | B2 * | 2/2008 | Stirm et al. | 173/201 |
| 2008/0047723 | A1 * | 2/2008 | Kamegai et al. | 173/109 |

FOREIGN PATENT DOCUMENTS

| | | | |
|---|---|---|---|
| CN | 101062558 | A | 10/2007 |
| DE | 102008000677 | A1 | 9/2009 |
| EP | 1000712 | A2 | 5/2000 |
| EP | 1779979 | A1 | 5/2007 |
| JP | 2007175836 | A | 7/2007 |
| WO | 2004082897 | A1 | 9/2004 |
| WO | 2008010467 | A1 | 1/2008 |

* cited by examiner

*Primary Examiner* — Paul R Durand
*Assistant Examiner* — Nathaniel Chukwurah
(74) *Attorney, Agent, or Firm* — Ronald E. Creigg

(57) ABSTRACT

The invention relates to a hand-held tool, in particular a rotary hammer, a percussion hammer, or a sabre saw. The hand-held tool is equipped with a drive unit and a stroke-generating element; the drive unit is embodied to move the stroke-generating element in a reciprocating fashion along a translation axis. The hand-held tool has at least one counterweight; the counterweight is operatively connected to the drive unit in such a way that it is possible to at least partially compensate for forces at least indirectly caused by the reciprocating motion. According to the invention, the counterweight in the hand-held tool is supported so that it is able to move, in particular to reciprocate, coaxial or parallel to the translation axis.

17 Claims, 4 Drawing Sheets

HAND-HELD TOOL WITH A COUNTER-VIBRATION DEVICE

CROSS-REFERENCE TO RELATED APPLICATION

This application is based on German Patent Application 10 2009 001 590.6 filed Mar. 17, 2009.

BACKGROUND OF THE INVENTION

1. Field of the Invention

The invention relates to a hand-held tool, in particular a rotary hammer, a percussion hammer, or a saw such as a sabre saw.

2. Description of the Prior Art

Hand-held tools known from the prior art have the problem that the counter-vibration device must be mounted in a complex fashion during production of the hand-held tool, particularly if the counter-vibration device is connected to a wobble bearing and is driven by means of it.

ADVANTAGES AND SUMMARY OF THE INVENTION

According to the invention, in the hand-held tool, the counterweight is supported so that it is able to move, in particular to reciprocate, coaxial or parallel to the translation axis. Preferably, the counterweight is supported in a guide element separate from the stroke-generating element. For example, the guide element is embodied in the form of a hollow cylinder, an elongated cup, a guide rod, or a guide rail.

Preferably, the hand-held tool has a holding device for a tool; the holding device for the tool is operationally connected to the stroke-generating element.

For example, in the case of a rotary hammer or a percussion hammer, the hand-held tool can be equipped with an impact mechanism in which a striking element that can be moved in reciprocating fashion is coupled by an air volume to the stroke-generating element, for example a piston. The stroke-generating element is thus able to move the striking element in reciprocating fashion via the air volume and thus to move it against an impact-receiving element, in particular an impact die.

By use of the counterweight, which is in particular movably supported by a guide means, it is advantageously possible to simplify an installation of the counterweight during assembly of the hand-held tool. The hand-held tool can therefore be manufactured in advantageous way in terms of its complexity.

In a preferred embodiment, the counterweight is supported in a bushing that functions as a guide and is in particular embodied of one piece. For example, the bushing can be composed of a tube, an elongated cup, or a hollow cylinder. The bushing, which is in particular embodied of one piece, can advantageously be manufactured in a simple way, for example by a continuous casting process. In a likewise advantageous fashion, the counterweight can be preassembled with the bushing and prepared for attachment to the hand-held tool, preferably in a smoothly lubricated fashion.

In an advantageous embodiment of the hand-held tool, the bushing is embodied in the form of a hollow cylinder. The bushing is preferably embodied to at least partially accommodate the counterweight. Preferably, the bushing has an opening for the engagement of a wobble pin; the counterweight is attached to the wobble pin in such a way that the wobble pin can move the counterweight in a reciprocating fashion, in particular via a bolt extending through the opening. Via the opening for the engagement of the wobble pin, the counterweight or additionally the bolt, together with the bushing, can be situated in an advantageously space-saving fashion in the hand-held tool, particularly in a housing of the hand-held tool.

In a preferred embodiment of the hand-held tool, the bushing has an installation viewing opening. Through the installation viewing opening, it is possible to observe a threading of the counterweight or additionally of the bolt, onto the wobble pin or in particular, to assist this procedure by reaching through the installation viewing opening. The installation viewing opening advantageously facilitates the attachment of the wobble pin to the counterweight, particularly in comparison to a concealed installation.

In a preferred embodiment, the hand-held tool has at least one guide rod. The counterweight is connected to the guide rod in such a way that the counterweight can be moved in reciprocating fashion in the longitudinal direction of the guide rod. Preferably, at least part of the counterweight has an opening, in particular an elongated lumen in which the guide rod is situated extending through the lumen. The counterweight can thus be advantageously moved in reciprocating fashion on the guide rod, with the guide rod at least partially accommodated in the lumen.

In a preferred embodiment, the counterweight is connected to a guide rail and is supported by the guide rail so that it is able to move in reciprocating fashion. Preferably, the counterweight in this embodiment has an oblong hole in which the guide rail can engage, particularly in a form-locked fashion, so that the counterweight is able to execute a reciprocating motion in the direction of the oblong hole.

In a preferred embodiment, the counterweight constitutes a slider that at least partially encompasses a longitudinal section of the guide rod and can thus be moved in a reciprocating fashion relative to the guide rod. As a result, the counterweight, in particular the slider, is advantageously secured in a form-locked fashion transverse to the translation axis.

In the embodiment with the guide rail, the counterweight can also constitute a slider that at least partially encompasses a longitudinal section of the guide rail. The slider can thus be moved in reciprocating fashion relative to the guide rail. For example, the slider can at least partially encompass the guide rail via an oblong hole.

The guide element is preferably a component produced by continuous casting. Preferably, the guide element is equipped with or made of a plastic, in particular a polymer. For example, the polymer can be polypropylene, polyethylene, polycarbonate, or polyamide. In another embodiment, the guide element is composed of a metal, for example iron, cast iron, steel, light alloy, in particular aluminum, or brass. The guide means is preferably equipped with a sliding layer, for example composed of polytetrafluoroethylene, on an inner wall embodied for sliding contact with the counter-vibration device.

Preferably, the hand-held tool advantageously weighs up to 3 kilograms.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
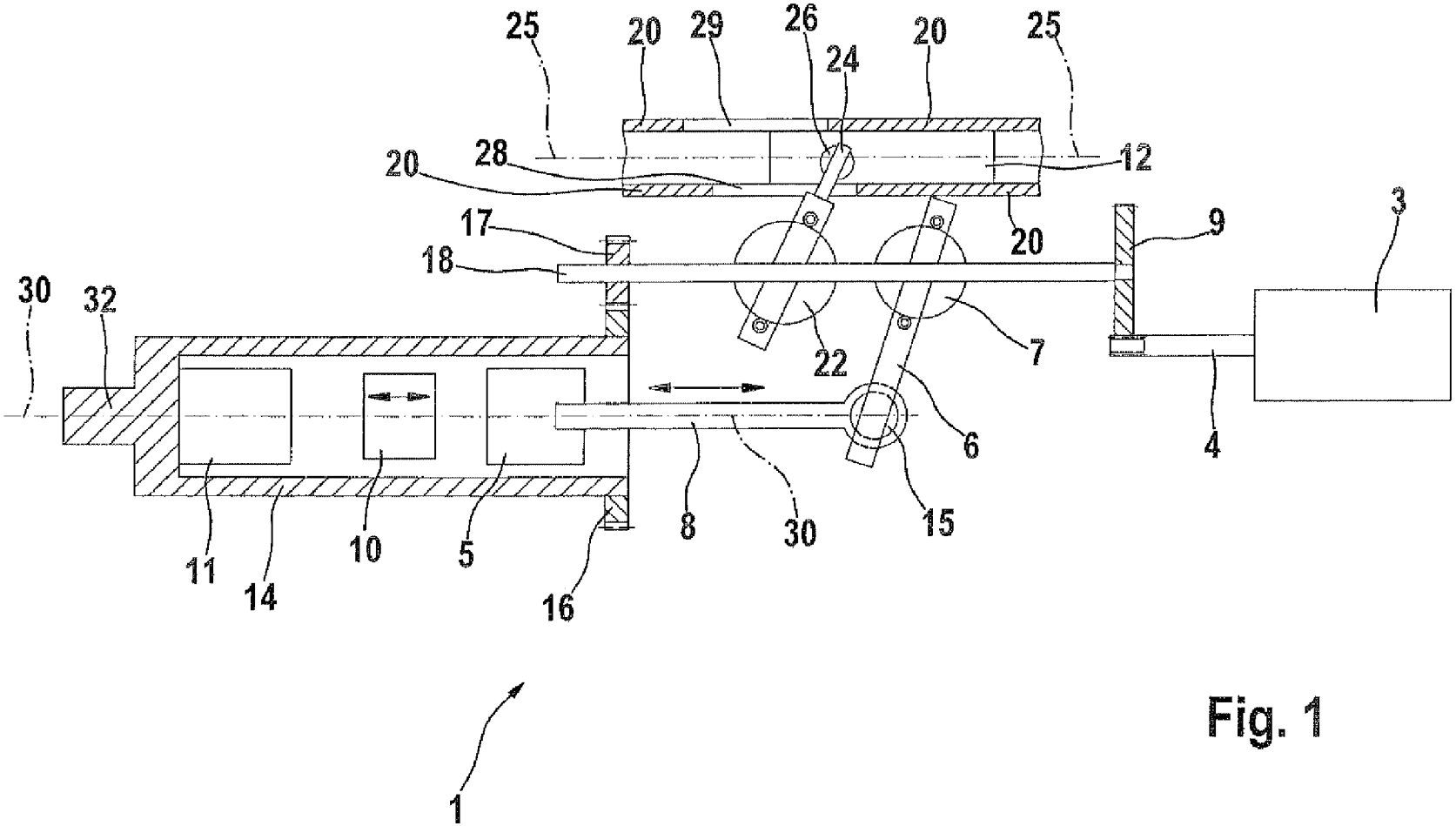
FIG. 1 schematically depicts an exemplary embodiment for a hand-held tool embodied in the form of a rotary hammer.

FIG. 1 schematically depicts an exemplary embodiment for a hand-held tool, a rotary hammer in this exemplary embodiment. The hand-held tool 1 has a drive unit with a drive motor 3. The drive motor 3 has a drive shaft 4 in whose end section a drive gear is provided. The drive gear of the drive shaft 4 operatively engages with a gearing of a gear 9. The gear 9 is situated on an intermediate shaft 18 on which a wobble bearing 7 is also situated. The wobble bearing 7 has a wobble pin 6; the wobble pin 6 engages in an opening of a bolt 15 connected to a connecting rod 8. The connecting rod 8 is connected to a stroke-generating element 5. In this exemplary embodiment, the stroke-generating element 5 is embodied in the form of a piston. The stroke-generating element 5 is operatively connected via an air volume to a striking element 10 that can be moved in a reciprocating fashion.

In lieu of the connecting rod 8, it is also possible for a push rod to be provided, which at least partially encompasses the bolt so that it is able to rotate around a rotation axis extending transversely to a longitudinal axis of the push rod so that the wobble pin 6 can move in reciprocating fashion in an opening of the bolt 15. Consequently, when the drive motor 3 rotates the intermediate shaft 18, the wobble pin 6 is able to move the stroke-generating element in a reciprocating fashion.

The stroke-generating element 5, the striking element 10, and an anvil or impact die 11 are all situated in a lumen inside a tool spindle 14.

In the vicinity of one end, the tool spindle 14 has a holding device 32 for a tool. The tool spindle 14 has a spindle drive gear 16 with a gearing that is operatively engaged in a meshing fashion with a gear 17, said gear 17 being situated on the intermediate shaft 18. Spaced a predetermined distance apart from the gear 17 along an intermediate shaft axis of the intermediate shaft 18, a wobble bearing 22 is mounted to the intermediate shaft 18 for co-rotation. The wobble bearing 22 is connected to a wobble pin 24; the wobble pin 24 engages in a bolt 26. The bolt 26 is embodied in cylindrical fashion and is situated in a counterweight 12 embodied in the form of a counter-vibration device. The counterweight 12, guided by a guide means 20, is situated so that it is able to move in reciprocating fashion along a translation axis 25. The guide means 20 in this exemplary embodiment is embodied as a bushing in the form of a hollow cylinder. The guide means 20 has an elongated opening 28 through which the wobble pin 24 engages in the counterweight 12 via the bolt 26.

The guide means 20 also has another opening 29 that is situated on the side opposite from the opening 28 in the circumference direction around the translation axis 25 and advantageously facilitates an insertion of the wobble pin 24 during a mounting of the counterweight 12 together with the guide means 20 onto a housing of the hand-held tool, for example.

The stroke-generating element 5, the striking element 10, and the connecting rod 8 are situated so that they are able to move in a reciprocating fashion along a translation axis 30; the translation axis 30 in this exemplary embodiment also constitutes a hammering axis along which the striking element 10 can hammer against the anvil or impact die 11.

Figure 2:
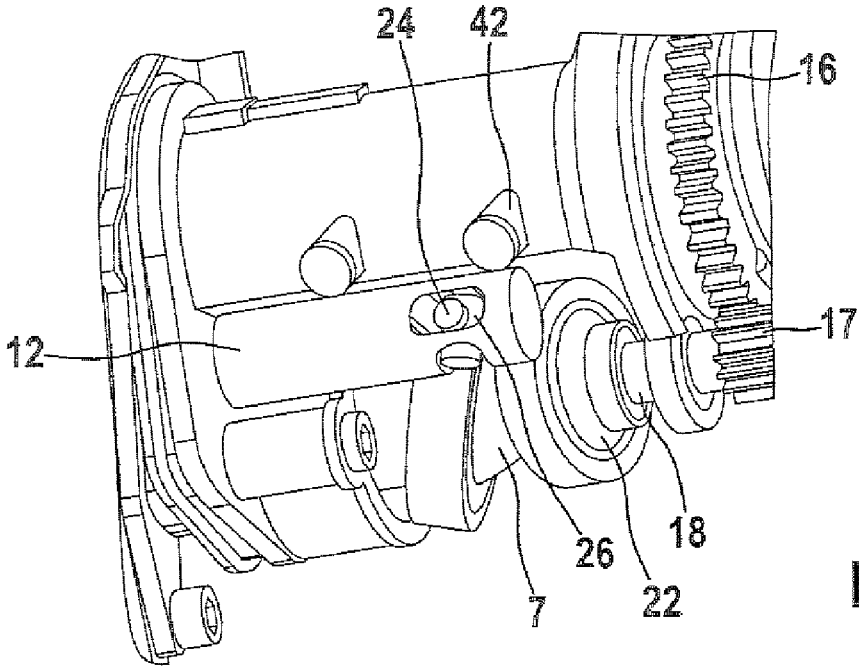
FIG. 2 shows a view of a spindle drive gear-driven intermediate shaft equipped with a wobble bearing, which operationally engages a counter-vibration device via a wobble pin.

FIG. 2 shows an exemplary embodiment for a part of a rotary hammer, for example the rotary hammer 1 that has already been schematically depicted in FIG. 1. FIG. 2 shows the spindle drive gear 16, the gear 17 on the intermediate shaft 18, the wobble bearing 22, and the bolt 26 situated in the counterweight 12; the wobble pin 24 connected to the wobble bearing 22 engages in the bolt 26 and therefore also in the counterweight 12. For better comprehension of the operative engagement, the counterweight in FIG. 2 is shown without the guide means 20 depicted in FIG. 1. Two screw bosses are formed onto a housing part, to which the guide means depicted in FIG. 1 can be fastened. The screw boss 42 is depicted by way of example. For example, the housing part is a bearing flange that at least partially accommodates and/or supports moving parts such as the intermediate shaft or the tool spindle or both. The drawing also shows the wobble bearing 7 shown in FIG. 1, which drives the stroke-generating element 5.

Figure 3:
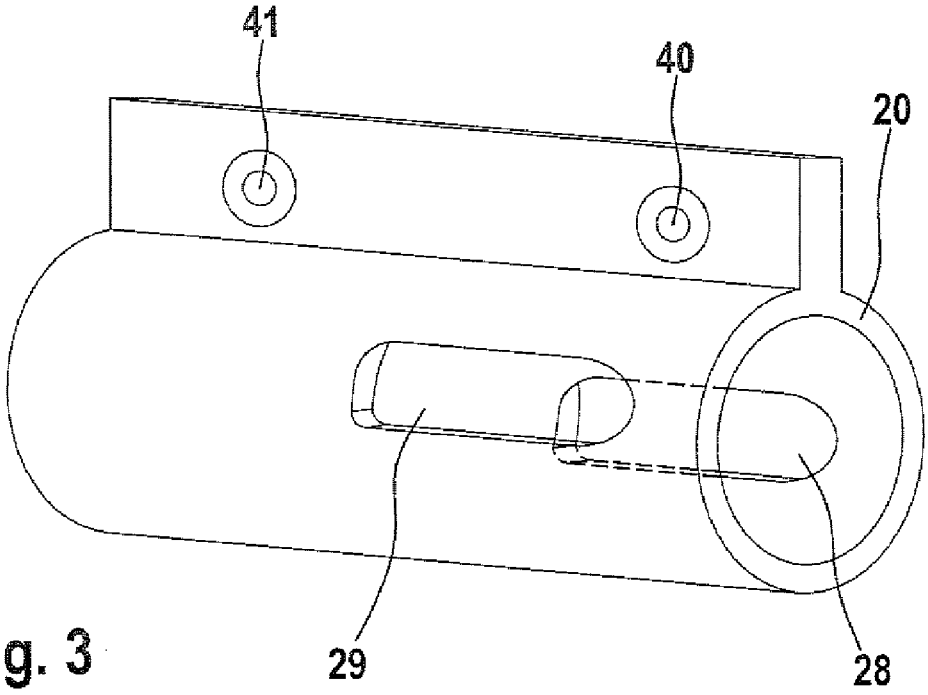
FIG. 3 schematically depicts an exemplary embodiment for a guide means that is embodied in the form of an elongated cup and is for guiding a counter-vibration device.

FIG. 3 shows an exemplary embodiment for a guide means 20. The guide means 20 has already been shown in FIG. 1 in connection with the hand-held tool 1 shown in FIG. 1. The guide means 20 in this exemplary embodiment is embodied as a bushing in the form of a hollow cylinder; the hollow cylinder is equipped with a fastening rib that contains two fastening holes for attaching the guide means 20, for example, to the screw bosses shown in FIG. 2, namely a fastening hole 40 and a fastening hole 41. The drawing also shows the opening 28 embodied in the form of an oblong hole through which the wobble pin 24 already shown in FIGS. 1 and 2 can reach and is therefore able to move the counterweight 12, which is situated in the lumen of the guide means 20, in a reciprocating fashion. The opening 28 in this exemplary embodiment is embodied in the form of an oblong hole. In an embodiment that is different, but operates in the same way, the opening 28 can be embodied in the form of a slot that extends along a longitudinal section or along the entire length of the guide means 20. The drawing also shows the opening 29 embodied in the faun of an oblong hole in this exemplary embodiment, which facilitates an installation, in particular an insertion of the wobble pin 24 into the bolt 26 and the counterweight 12.

Figure 4:
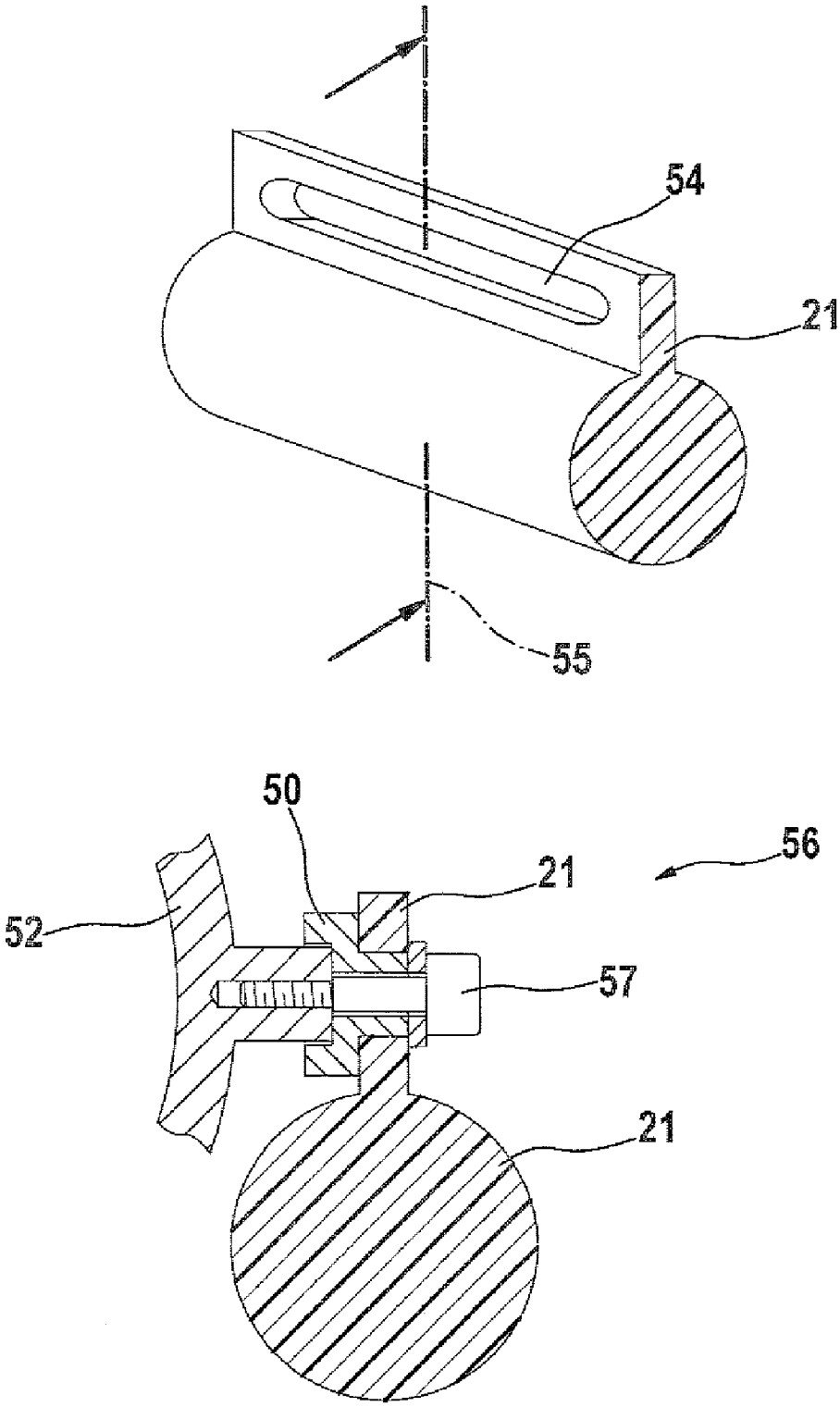
FIG. 4 shows an exemplary embodiment for a counter-vibration device, which is for a hand-held tool and is embodied to be guided by means of a guide rail.

FIG. 4 shows an exemplary embodiment for a counterweight 21 with an integrated guide means, which, by contrast with the guide means 20 shown in FIGS. 1, 2, and 3, is solid and embodied as at least partially cylindrical. A rib in which an oblong hole 54 is embodied is formed onto the solid cylinder.

An illustration 56 shows a sectional depiction of the counterweight 21 along a cutting line 55.

The oblong hole 54 is embodied for the engagement of a guide rail 50. Oriented transversely to a guide rail longitudinal direction, the guide rail 50 has an end that is stepped in a tapering fashion, which is embodied to reach through the oblong hole 54. In the region of another end, the guide rail has a preferably cylindrical recess for the attachment of the guide rail 50. The drawing also shows part of a housing 52 to which the guide rail 50 is fastened by means of a spacer screw 57. For example, the counterweight 21 is driven by means of a wobble pin, not shown in this drawing, which reaches into a bolt supported in rotary fashion in the counterweight 21 and is thus operatively connected to the counterweight 21.

Figure 5:
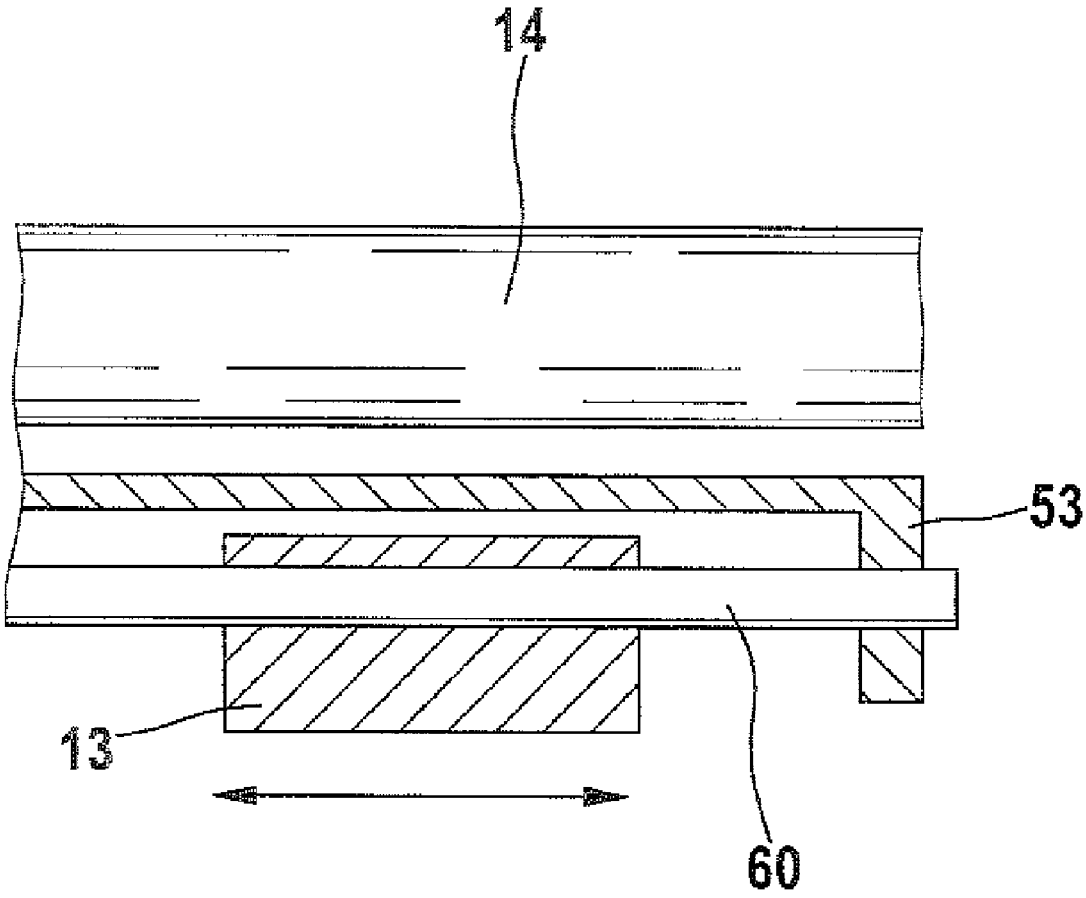
FIG. 5 schematically depicts an exemplary embodiment for a counter-vibration device that is guided on a guide rod and is for a hand-held tool.

FIG. 5 shows an exemplary embodiment for a counterweight 13, which, by contrast with the counterweight 12 shown in FIGS. 1 and 2, is guided on a guide rod 60. The counterweight 13 has a lumen extending lengthwise inside the counterweight 13, through which the guide rod 60 passes. The counterweight 13 is thus able to move in a reciprocating fashion as a slider on the guide rod 60. The guide rod 60 engages in an angle 53 of the housing of the rotary hammer and is thus connected to the housing. The drawing also shows a tool spindle, for example the tool spindle 14 shown in FIG. 1. For example, the counterweight 13 is driven by means of a wobble pin, not shown in this drawing, which reaches into a bolt supported in rotary fashion in the counterweight 13 and is thus operatively connected to the counterweight 13.

The foregoing relates to preferred exemplary embodiments of the invention, it being understood that other variants and embodiments thereof are possible within the spirit and scope of the invention, the latter being defined by the appended claims.

The invention claimed is:

1. A hand-held tool, comprising:

a drive unit and a stroke-generating element, the drive unit being embodied to move the stroke-generating element in a reciprocating, periodic motion along a translation axis; and at least one counterweight operatively connected to the drive unit to at least partially compensate for forces at least indirectly caused by the reciprocating motion, the at least one counterweight being supported by a bushing to reciprocate coaxially or parallel to the translation axis, wherein the bushing is embodied as a hollow cylinder having a cylindrical wall and the at least one counterweight is at least partially accommodated within the hollow cylinder, wherein the cylindrical wall has an elongated opening extending along a length of the cylinder through which a wobble pin extends for engagement with the at least one counterweight, and wherein the at least one counterweight is attached to the wobble pin such that the wobble pin moves the at least one counterweight in a reciprocating fashion through the elongated opening in the cylindrical wall of the bushing.

2. The hand-held tool as recited in claim 1, wherein the bushing is embodied of one piece.

3. The hand-held tool as recited in claim 2, wherein the cylindrical wall of the bushing has an installation viewing opening and through the installation viewing opening the at least one counterweight is threaded onto the wobble pin.

4. The hand-held tool as recited in claim 1, wherein the cylindrical wall of the bushing has an installation viewing opening and through the installation viewing opening the at least one counterweight is threaded onto the wobble pin.

5. The hand-held tool as recited in claim 4, wherein the installation viewing opening is situated opposite the elongated opening in a circumferential direction around a translation axis of the at least one counterweight.

6. The hand-held tool as recited in claim 4, wherein the at least one counterweight is threaded onto the wobble pin via a bolt.

7. The hand-held tool as recited in claim 1, wherein the at least one counterweight is attached to the wobble pin via a bolt situated in the at least one counterweight.

8. The hand-held tool as recited in claim 1, wherein the hollow cylinder has a fastening rib containing holes for attaching the cylinder to a housing part of the tool.

9. A hand-held tool, comprising: a drive unit and a stroke-generating element, the drive unit being embodied to move the stroke-generating element in a reciprocating, periodic motion along a translation axis; and at least one counterweight operatively connected to the drive unit to at least partially compensate for forces at least indirectly caused by the reciprocating motion, the at least one counterweight being supported to reciprocate coaxially or parallel to the translation axis, wherein the at least one counterweight is supported in a bushing that is embodied of one piece, and wherein the bushing has an installation viewing opening and through the installation viewing opening the at least one counterweight is threaded onto a wobble pin.

10. The hand-held tool as recited in claim 9, wherein the bushing is embodied as a hollow cylinder and the bushing is embodied to at least partially accommodate the at least one counterweight.

11. The hand-held tool as recited in claim 9, wherein the bushing has an elongated opening for engagement of a wobble pin and the at least one counterweight is attached to the wobble pin to move the at least on counterweight in a reciprocating fashion through the elongated opening.

12. The hand-held tool as recited in claim 11, wherein the installation viewing opening is situated opposite the elongated opening in a circumferential direction around a translation axis of the at least one counterweight.

13. A hand-held tool, comprising: a drive unit and a stroke-generating element, the drive unit being embodied to move the stroke-generating element in a reciprocating, periodic motion along a translation axis; and at least one counterweight operatively connected to the drive unit to at least partially compensate for forces at least indirectly caused by the reciprocating motion, the at least one counterweight being supported to reciprocate coaxially or parallel to the translation axis, wherein the at least one counterweight is solid and is embodied as at least partially cylindrical, and wherein the at least one counterweight has a rib with an oblong hole formed therein which is embodied for engagement with a guide rail.

14. The hand-held tool as recited in claim 13, wherein the rib of the at least one counterweight is connected to the guide rail via the oblong hole and is supported by the guide rail to move in reciprocating fashion.

15. The hand-held tool as recited in claim 13, wherein the at least one counterweight constitutes a slider that at least partially encompasses a longitudinal section of the guide rail and is moved in a reciprocating fashion relative to the guide rail.

16. The hand-held tool as recited in claim 15, wherein the guide rail has an end that is stepped in a tapering fashion and is embodied to extend through the oblong hole in the rib.

17. The hand-held tool as recited in claim 16, wherein the guide rail has a recess for attachment of the guide rail to a housing part of the tool.

* * * * *